US008047899B2

(12) United States Patent
Chen et al.

(10) Patent No.: US 8,047,899 B2
(45) Date of Patent: Nov. 1, 2011

(54) PAD AND METHOD FOR CHEMICAL MECHANICAL POLISHING

(75) Inventors: Chun-Fu Chen, Taipei (TW); Yung-Tai Hung, Chiayi (TW); Chin-Ta Su, Yunlin (TW); Kuang-Chao Chen, Taipei (TW)

(73) Assignee: Macronix International Co., Ltd., Hsinchu (TW)

( * ) Notice: Subject to any disclaimer, the term of this patent is extended or adjusted under 35 U.S.C. 154(b) by 825 days.

(21) Appl. No.: 11/878,654

(22) Filed: Jul. 26, 2007

(65) Prior Publication Data

US 2009/0029551 A1 Jan. 29, 2009

(51) Int. Cl.
*B24B 7/22* (2006.01)
*B24D 3/34* (2006.01)

(52) U.S. Cl. ..... 451/41; 451/527; 51/298

(58) Field of Classification Search ..... 451/41, 451/526, 527, 530, 533, 534; 51/293, 297, 51/298

See application file for complete search history.

(56) References Cited

U.S. PATENT DOCUMENTS 5,733,176 A * 3/1998 Robinson et al. ..... 451/41
6,039,633 A * 3/2000 Chopra ..... 451/41
6,932,687 B2 * 8/2005 Agarwal et al. ..... 451/41
2002/0034876 A1 3/2002 Han
2007/0135030 A1 6/2007 Shih

FOREIGN PATENT DOCUMENTS

CN 1320610 C 6/2007

OTHER PUBLICATIONS

Xin, Wei et al., Study on the Performances of Polishing Pad in Chemical-Mechanical Polishing, Faculty of Electromechanical Engineering, Guangdong University of Technology, Guangzhou 510090, China, Diamond & Abrasives Engineering, Oct. 2004, Serial 143, No. 5.

Taiwanese Office Action in corresponding Taiwanese Application No. 096143290, dated May 30, 2011.

* cited by examiner

*Primary Examiner* — Robert Rose
(74) *Attorney, Agent, or Firm* — Bacon & Thomas, PLLC

(57) ABSTRACT

A method for chemical-mechanical polishing two adjacent structures of a semiconductor device is provided. The method for mechanical polishing comprising: (a) providing a semiconductor device comprising a recess formed in a surface thereof, a first layer formed over the surface, and a second layer filled with the recess and formed on the first layer; and (b) substantially polishing the first and second layer with a pad and a substantially inhibitor-free slurry, wherein the pad comprising a corrosion inhibitor of the second layer.

5 Claims, 5 Drawing Sheets

PAD AND METHOD FOR CHEMICAL MECHANICAL POLISHING

BACKGROUND OF THE INVENTION

1. Field of the Invention

The invention relates in general to a pad and a method for chemical mechanical polishing, and more particularly to a pad comprising a corrosion inhibitor and method for chemical mechanical polishing using the same.

2. Description of the Related Art

Reliably producing sub-half micron and smaller features is one of the key technologies for the next generation of very large scale integration (VLSI) and ultra large-scale integration (ULSI) of semiconductor devices. However, as the limits of circuit technology are pushed, the shrinking dimensions of interconnects in VLSI and ULSI technology have placed additional demands on processing capabilities. Reliable formation of interconnects is important to VLSI and ULSI success and to the continued effort to increase circuit density and quality of individual substrates and die.

Multilevel interconnects are formed using sequential material deposition and material removal techniques on a substrate surface to form features therein. As layers of materials are sequentially deposited and removed, the uppermost surface of the substrate may become non-planar across its surface and require planarization prior to further processing. Planarization or "polishing" is a process where material is removed from the surface of the substrate to form a generally even, planar surface. Planarization is useful in removing excess deposited material, removing undesired surface topography, and surface defects, such as surface roughness, agglomerated materials, crystal lattice damage, scratches, and contaminated layers or materials to provide an even surface for subsequent photolithography and other semiconductor processes.

Chemical mechanical planarization, or chemical mechanical polishing (CMP), is a common technique used to planarize substrates. In conventional CMP techniques, a substrate carrier or polishing head is mounted on a carrier assembly and positioned in contact with a polishing article in a CMP apparatus. The carrier assembly provides a controllable pressure to the substrate urging the substrate against the polishing pad. The pad is moved relative to the substrate by an external driving force. Thus, the CMP apparatus effects polishing or rubbing movement between the surface of the substrate and the polishing article while dispersing a polishing composition to effect both chemical activity and mechanical activity.

However, materials deposited on the surface of a substrate 10 to fill feature definitions formed therein often result in unevenly formed surfaces. Polishing of surfaces with excess material, called overburden, may result in the retention of residues from inadequate metal removal over one feature definition 15. Overpolishing processes to remove such residues may result in excess metal removal over another feature definition 25. Excess metal removal can form topographical defects, such as concavities or depressions known as dishing 30, over features 25, as shown in FIG. 1.

Dishing of features and retention of residues on the substrate surface are undesirable since dishing and residues may detrimentally affect subsequent processing of the substrate. For example, dishing results in a non-planar surface that impairs the ability to print high-resolution lines during subsequent photolithographic steps and detrimentally affects subsequent surface topography of the substrate, which affects device formation and yields. Dishing also detrimentally affects the performance of devices by lowering the conductance and increasing the resistance of the devices, causing device variability and device yield loss. Residues may lead to uneven polishing of subsequent materials, such as barrier layer materials (not shown) disposed between the conductive material and the substrate surface. Uneven polishing will also increase defect formation in devices and reduce substrate yields.

Therefore, there is a need for compositions and methods for removing material from a substrate that minimizes damage to the substrate during planarization.

SUMMARY OF THE INVENTION

The invention is directed to a method for chemical mechanical polishing two adjacent structures by using a pad comprising corrosion inhibitor, being capable of improving the dishing effect and lowering the manufacturing cost.

According to a first aspect of the present invention, a pad for chemical mechanical polishing is provided. The pad comprises a base layer and a corrosion inhibitor combined with the base layer.

According to a second aspect of the present invention, a method for chemical-mechanical polishing two adjacent structures of a semiconductor device is provided. The method for mechanical polishing comprising: (a) providing a semiconductor device comprising a recess formed in a surface thereof, a first layer formed over the surface, and a second layer filled with the recess and formed on the first layer; and (b) substantially polishing the first and second layer with a pad and a substantially inhibitor-free slurry, wherein the pad comprising a corrosion inhibitor of the second layer.

The invention will become apparent from the following detailed description of the preferred but non-limiting embodiments. The following description is made with reference to the accompanying drawings.

DETAILED DESCRIPTION OF THE INVENTION

Figure 1:
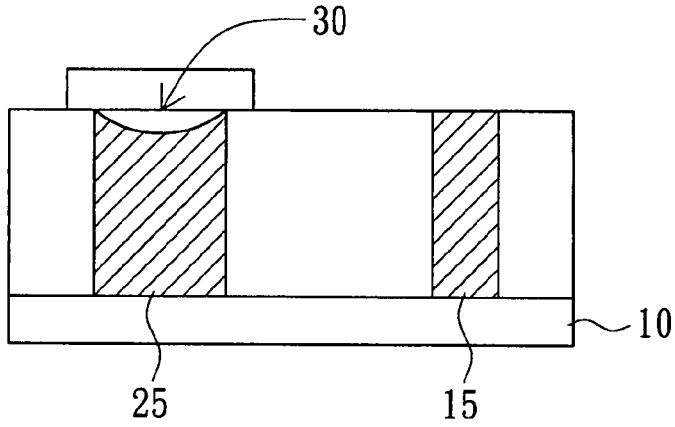
FIG. 1(PRIOR ART)
FIG. 1 (Prior Art) is a cross section view illustrating a dishing effect resulted from a conventional process.
Figure 2A:
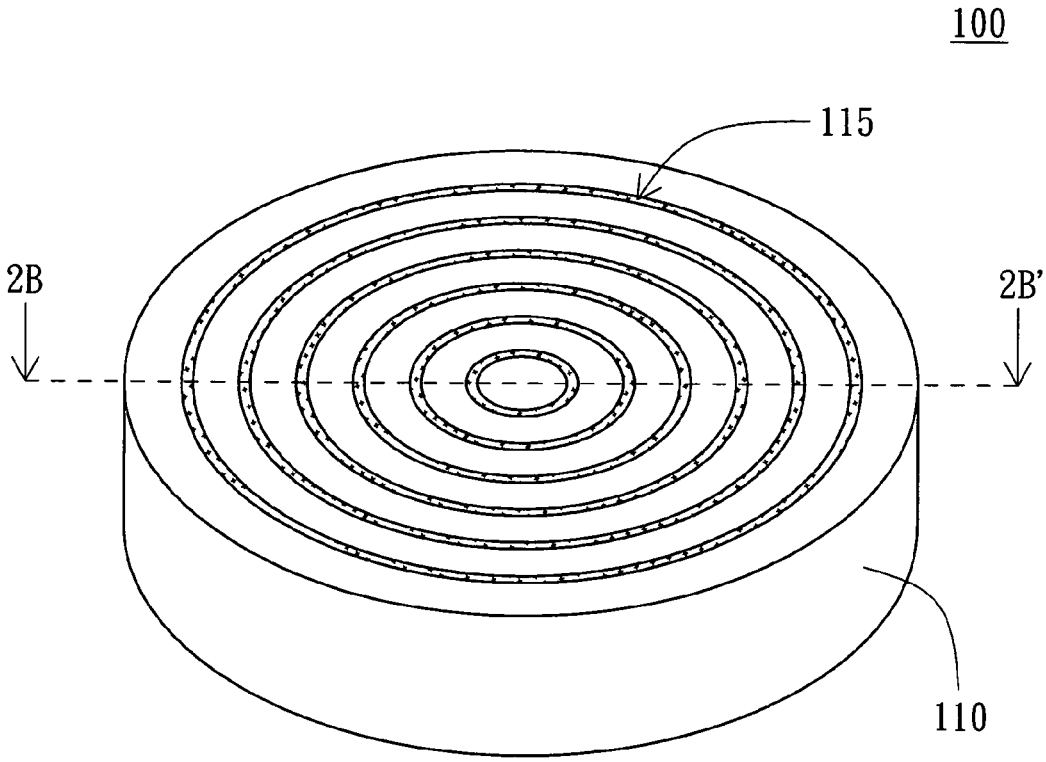
FIG. 2A is schematic a perspective view illustrating a pad according to the preferred embodiment of the invention.
Figure 2B:
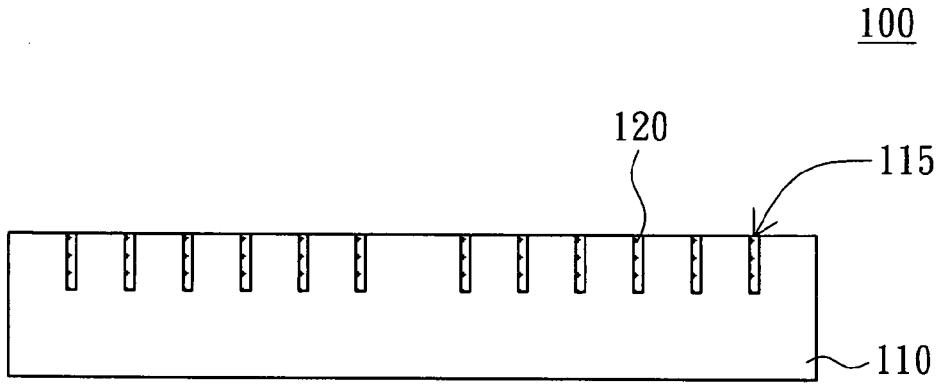
FIG. 2B is a cross sectional view taken along the line 2B-2B' of FIG. 2A.

The invention is directed to a pad for chemical-mechanical polishing (CMP) comprises corrosion inhibitor therein. The pad includes a base layer and a corrosion inhibitor combined with the base layer. The combination could be embodied in several ways. FIG. 2A is schematic a perspective view illustrating a pad according to the preferred embodiment of the invention, and FIG. 2B is a cross sectional view taken along the line 2B-2B' of FIG. 2A. The pad 100 of the first example includes a base layer 110 made of polymer resin. The polymer resin can be thermoplastic elastomers, thermoset polymers, polyurethanes, polyolefins, polycarbonates, fluorocarbons, polyacrylamides, polyesters, polyethers, polyamides, polyvinylacetates, polyvinylalcohols, nylons, polypropylenes, nylons, elastomeric rubbers, polyethylenes, polytetrafluoroethylenes, polyetheretherketones, polyethyleneterephthalates, polyimides, polyaramides, polyarylenes, polyacrylates, polyacrylic acids, polystyrenes, polymethylmethacrylates, copolymers thereof, or mixtures thereof. The base layer 110 has at least one groove atop. The base layer preferably has many concentric grooves 115 on the top surface. Referring to FIG. 2B, the grooves 115 on the base layer are filled with the corrosion inhibitor 120. The corrosion inhibitor 120 includes glycine, L-proline, aminopropylsilanol, aminopropylsiloxane, dodecylamine, lysine, tyrosine, glutamine, glutamic acid, or cystine. When being adopted to the chemical mechanical polishing, the pad 100 of the first example would be turned over so that the surface containing corrosion inhibitor could be attach to the surface to be polished.

Figure 3:
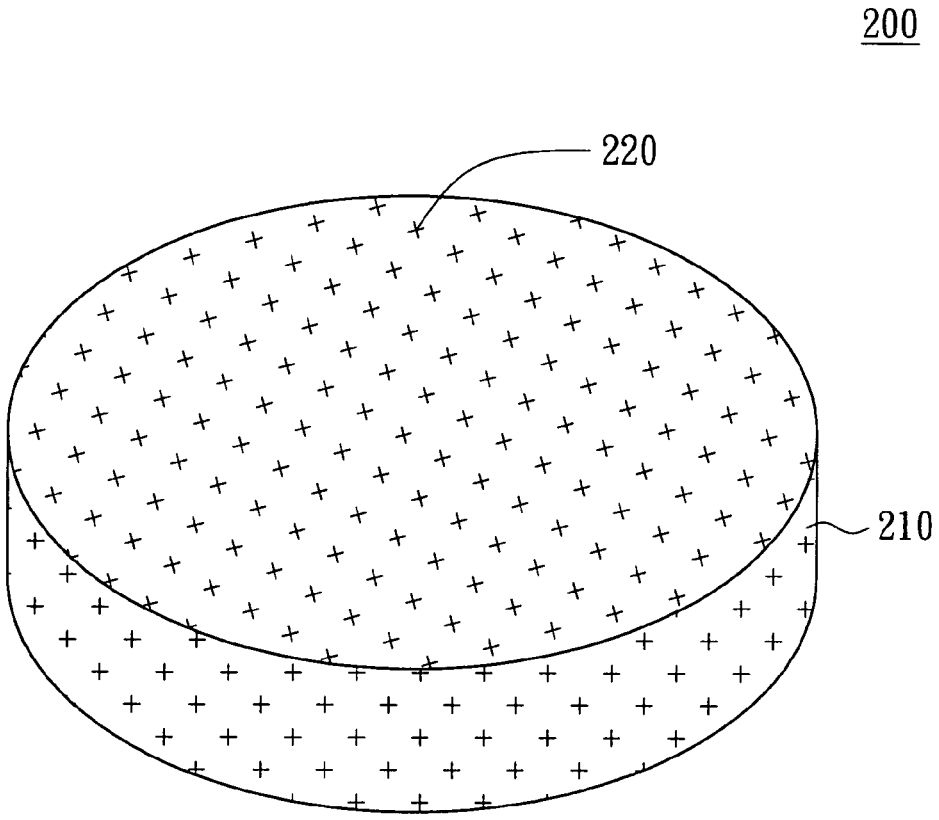
FIG. 3 schematically illustrates a perspective view of a pad according to another preferred embodiment of the invention.

FIG. 3 schematically illustrates a perspective view of a pad according to another preferred embodiment of the invention. The pad 200 of the second embodiment also includes the base layer 210 and the corrosion inhibitor 220. The base layer 210 is made of abrasive, and the corrosion inhibitor 220 is mixed with the abrasive so as to allow the corrosion inhibitor 220 to be distributed over the pad 200. The abrasive and the corrosion inhibitor will be both contact with and react with the surface to be polished during the CMP process.

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

According to preferred embodiment of the present invention, the method for chemical-mechanical polishing two adjacent structures of a semiconductor device includes at least two steps. Firstly, a semiconductor device comprising a recess formed in a surface thereof is provided. A first layer is formed over the surface, and a second layer is filled with the recess and formed on the first layer. Secondly, the first and second layers are substantially polished with a pad and a substantially inhibitor-free slurry, while the pad includes a corrosion inhibitor of the second layer. The pad is preferably formulated to effect a removal rate of the second layer is slower than a removal rate of the first layer. Since the corrosion inhibitor reacts with the second layer, the removal rate of the second layer is inhibited to prevent the dishing effect.

Figure 4A:
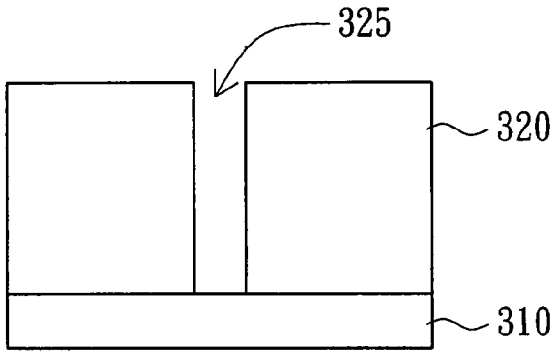
FIGS. 4A~4E are cross sectional view illustrating the formation of a metal plug by using the pad of FIG. 2A.
Figure 4B:
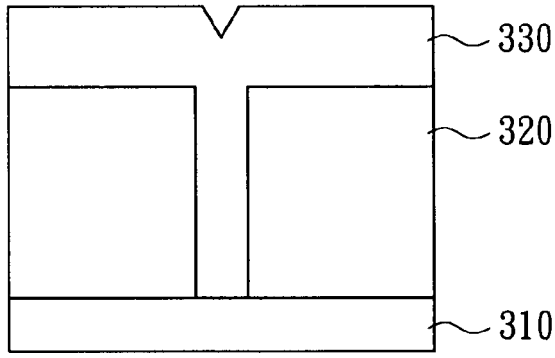
Figure 4C:
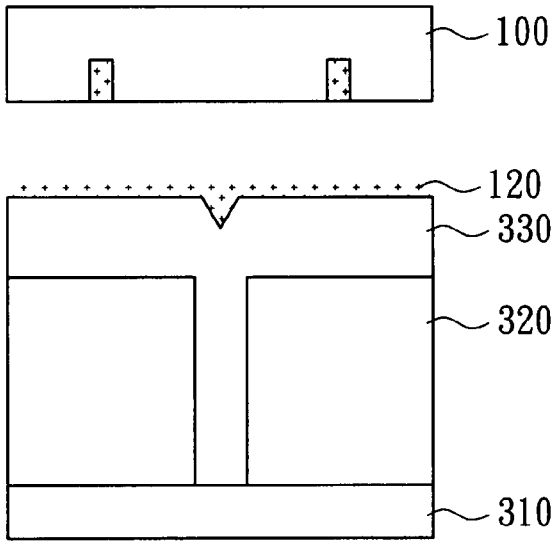
Figure 4D:
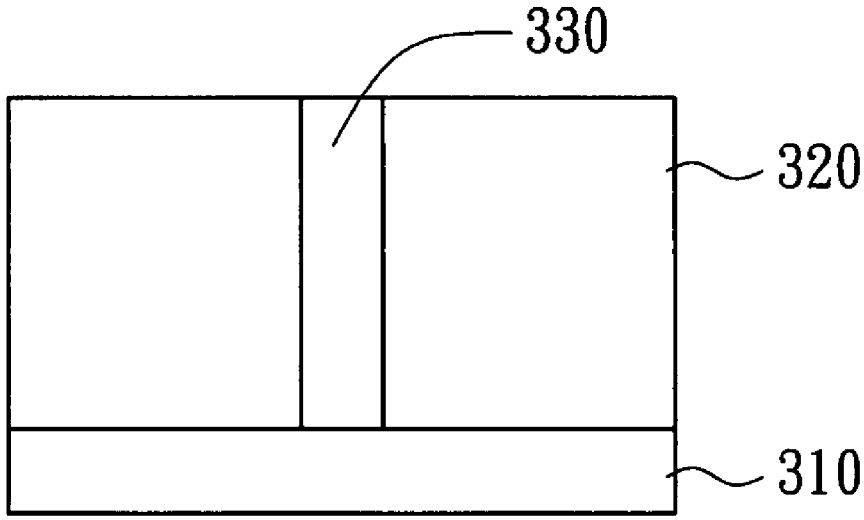
Figure 4E:
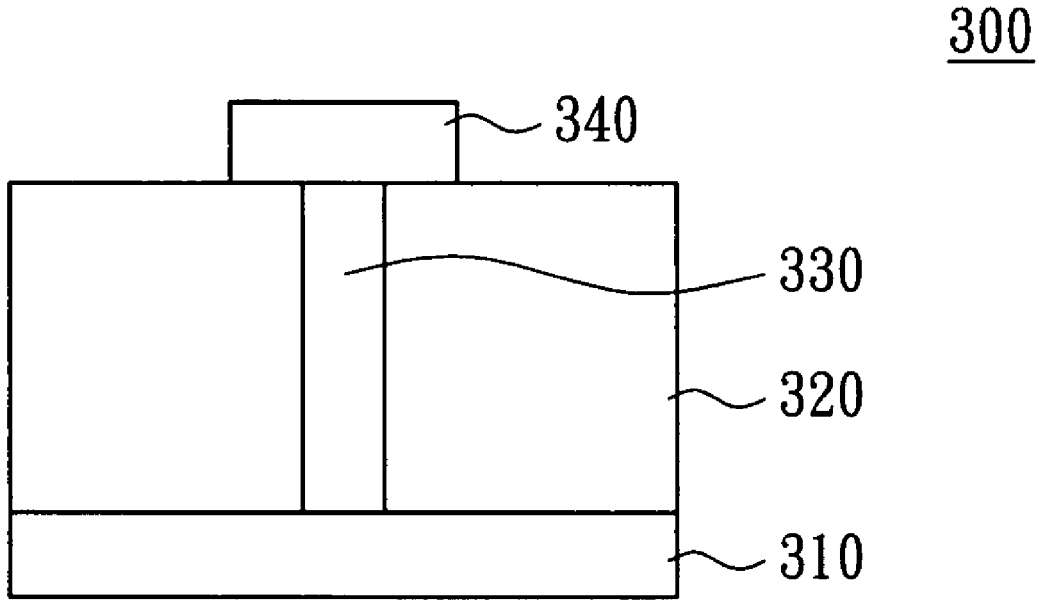

Formation of metal plug is taken for an example to illustrate the method for using the pad and CMP process. FIGS. 4A~4E are cross sectional view illustrating the formation of a metal plug by using the pad of FIG. 2A. A first layer (i.e. oxide layer 320), formed on the semiconductor device 310, has a recess 325, as shown in FIG. 4A. Then, second layer 330 (i.e. tungsten or copper) is filled with the recess 325 and formed on the first layer 310, as shown in FIG. 4B. Next, the second layer 330 is polished with the pad 100 of the preferred embodiment and inhibitor-free slurry, as shown in FIG. 4C. The pad 100 is mounted upside down to carry the corrosion inhibitor 120 to the semiconductor device. The polishing process will be carried on until the second layer 330 (i.e. tungsten or copper) are substantially at the same horizontal level as the first layer 320, as shown in FIG. 4D. In the polishing process, the corrosion inhibitor 120 mixed with the inhibitor-free slurry co-reacts with the second layer 330. Compared with the conventional polishing method in which the inhibitor-free slurry and the inhibitor-free pad co-react with the second layer, the polishing process of the present embodiment shows a slower removal rate of the second layer. Thus, the dishing effect of the second layer 330 could be improved. In addition, the pad containing the corrosion inhibitor could be made as pad 200 of FIG. 3 and would function as well. After polishing two adjacent structures, such as the first and second layers 320 and 330, another metal layer 340 contacts with the flat second layer 330 to form a plug. When an electric flux is applied to the metal layer 340, it flows through the second layer 330 and to the semiconductor device.

Figure 5A:
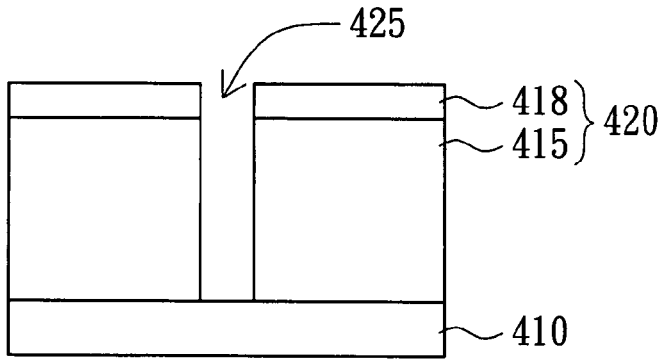
FIGS. 5A~5C are cross sectional view illustrating the formation of the shallow trench isolation (STI) by using the pad of FIG. 2A.
Figure 5B:
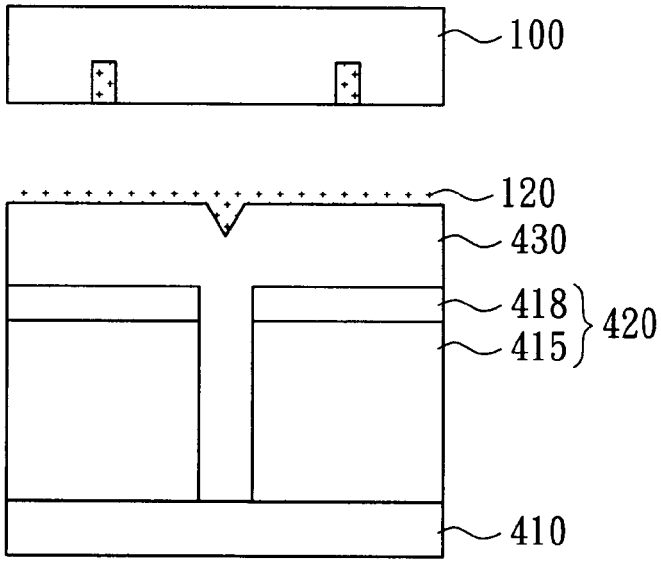
Figure 5C:
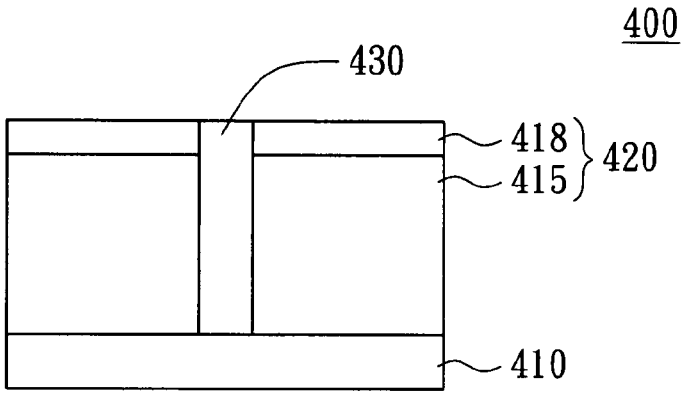

The pad for chemical mechanical polishing two adjacent pad of the present invention could be also applied to the partial steps of the shallow trench isolation (STI). FIGS. 5A~5C are cross sectional view illustrating the formation of the shallow trench isolation (STI) by using the pad of FIG. 2A. A semiconductor device 410 including a recess 425 formed in a surface of the semiconductor device, as shown in FIG. 5A. A first structure 420 including an oxide layer 415 and a silicon nitride layer 418 is formed on the surface, and then a second layer 430 (i.e. high density plasma oxide layer) is filled with the recess 425 and formed on the first structure 420, as shown in FIG. 5B. The second layer 430 is polished with the pad 100 of the preferred embodiment and inhibitor-free slurry. The pad 100 is mounted upside down to carry the corrosion inhibitor 120 to the semiconductor device. The polishing process will be carried on until the second layer 430 (i.e. HDP oxide layer) is substantially at the same horizontal level as the first structure 420, as shown in FIG. 5C. In the polishing process, the corrosion inhibitor 120 mixed with the inhibitor-free slurry co-reacts with the second layer 430. Compared with the conventional polishing method in which the inhibitor-free slurry and the inhibitor-free pad co-react with the second layer, the polishing process of the present embodiment shows a slower removal rate of the second layer. Thus, the dishing effect of the HDP oxide layer 430 could be improved in a similar way. For example, L-proline can improve the selectivity of the oxide layer to the silicon nitride layer during the CMP process. In addition, the pad containing the corrosion inhibitor could be made as pad 200 of FIG. 3 and would function as well. Two adjacent structures, such as the first structure 420 and the HDP oxide layer 430, are polished to from a flat and even surface to be further processed, as shown in FIG. 5C.

The pad and the method for chemical mechanical polishing two adjacent structures of the present invention have many advantages. The corrosion inhibitor combined with the pad, instead of the slurry, provides a less expensive and more effective way. The slurry, an expensive and consumptive material of high cost, is heavily used during the CMP process, as a mainly result of high cost of manufacture. The corrosion inhibitor embedded into or mixed with the pad, which is hard enough to be abraded slowly, will be delivered ceaselessly and continuously during the CMP process. The cost of the pad is much lower than that of the slurry, and the abraded rate of the pad is much slower than that of slurry consumed in once polishing process. Thus, the pad and the CMP process using the same of the invention provides a more effective way to improve the dishing effect during the CMP process.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A pad for chemical mechanical polishing, the pad comprising:

a base layer; and a plurality of corrosion inhibitors, concentrically arranged in the base layer, wherein all of the concentrically-arranged corrosion inhibitors are exposed on a top surface of the baser layer.

2. The pad according to claim 1, wherein the base layer is made of polymer resin.

3. The pad according claim 1, wherein the polymer resin is thermoplastic elastomers, thermoset polymers, polyurethanes, polyolefins, polycarbonates, fluorocarbons, polyacrylamides, polyesters, polyethers, polyamides, polyvinylacetates, polyvinylalcohols, nylons, polypropylenes, nylons, elastomeric rubbers, polyethylenes, polytetrafluoroethylenes, polyetheretherketones, polyethyleneterephthalates, polyimides, polyaramides, polyarylenes, polyacrylates, polyacrylic acids, polystyrenes, polymethylmethacrylates, copolymers thereof, or mixtures thereof.

4. The pad according to claim 1, wherein the base layer has a groove atop, and the groove is filled with the corrosion inhibitor.

5. The pad according to claim 1, wherein the corrosion inhibitor comprises glycine, L-proline, aminopropylsilanol, aminopropylsiloxane, dodecylamine, lysine, tyrosine, glutamine, glutamic acid, or cystine.

* * * * *